United States Patent [19]

Kaminski et al.

[11] Patent Number: 4,465,204

[45] Date of Patent: Aug. 14, 1984

[54] PULL TAB FOR EASY OPEN END

[75] Inventors: Elton G. Kaminski, Sidney; Carl F. McEldowney, Russia, both of Ohio

[73] Assignee: The Stolle Corporation, Sidney, Ohio

[21] Appl. No.: 513,447

[22] Filed: Jul. 13, 1983

[51] Int. Cl.[3] ..... B65D 17/34

[52] U.S. Cl. ..... 220/269

[58] Field of Search ..... 220/269–273; 413/12

[56] References Cited

U.S. PATENT DOCUMENTS

| | | | |
|---|---|---|---|
| 3,462,042 | 8/1969 | Stolle | 220/54 |
| 3,762,597 | 10/1973 | Kaminski et al. | 220/54 |
| 3,795,342 | 3/1974 | Ashton | 220/54 |
| 4,096,967 | 6/1978 | Kaminski | 220/269 |
| 4,372,462 | 2/1983 | Dassher et al. | 220/269 |
| 4,387,827 | 6/1983 | Ruemer, Jr. | 220/269 |
| 4,402,421 | 9/1983 | Ruemer, Jr. | 220/269 |

*Primary Examiner*—George T. Hall

*Attorney, Agent, or Firm*—Frost & Jacobs

[57] ABSTRACT

An easy open can end having a retained tear strip extending diametrically partly across the can end defined by a score line, and a graspable pull tab adjacent and outside the open end of the score line. The pull tab is provided with a nose portion to initiate a tear along the score line upon lifting of the pull tab. The edges of the nose portion are curled into a cylindrical cross-sectional shape to provide a high beam strength and to rigidize the nose portion and to prevent failure by bending before the tear strip is opened. A method for manufacture of the pull tab includes forming at least one relief knotch in the peripheral edge of the pull tab blank at the nose end thereof, whereby to relieve compressive forces when the edge is curled, and curling the peripheral edge of the nose portion in successive steps to form an edge portion of continuous cylindrical cross-sectional shape.

7 Claims, 16 Drawing Figures

4
1
2
3
5
6
IC
14
IA
18
IB
11
4
29
9
16
10
8
19
7

PULL TAB FOR EASY OPEN END

SUMMARY OF THE INVENTION

The present invention is directed to a pull tab for a metallic beverage-type can end or the like, and more particularly to a pull tab which is retained to the can end after opening.

Many metallic cans for holding beverages or other liquid products are provided with easy open ends having a pull tab attached to a tear strip defined by a score line in the can end which can be pulled to provide an opening in the end for dispensing the can contents.

For ecological and safety reasons, many areas now require that the tear strip and attached pull tab be retained to the can end after opening. In order to meet these requirements, various ways have been suggested for insuring that the tear strip and pull tab do not become separated from the can end. There are a number of prior art easy open can ends available, but the primary problem therewith is that the retained tab ends are difficult to open, require use of thick metal gauges and complicated and low productivity tooling. Since these versions are difficult and expensive to produce, the higher production costs are usually passed on to the consumer.

The present invention has developed a pull tab for use on retained pull tab easy open can ends which requires less tooling stations, utilizes less metal, is conducive to higher production rates and makes the can end easier to open. In the preferred embodiment illustrated, an easy open can end is provided having a score line defining a tear strip. The score line is generally U-shaped with the open end of the U towards the center of the can end and being interrupted so that the tear strip will be captively retained on the underside of the can end when torn open. An integral rivet is provided adjacent the open end of the U outside the score line, and the pull tab is secured to the can end by means of the rivet.

The pull tab is provided with a nose portion to initiate a tear along the score line upon lifting of the pull tab. The edges of the nose portion are curled into a cylindrical cross-sectional shape to provide a high beam strength and to rigidize the nose portion and to prevent failure by bending before the tear strip is opened.

When the pull tab is raised, the nose portion thereof initiates the tear along the score line, causing the tear strip to bend downwardly along a transverse line in front of the rivet, and when raised further, causing the score line to tear therearound, except for the interrupted portion thereof, so that the tear strip is captively retained on the underside of the can end, and when the tear strip is fully open, to be retracted so as to lie substantially flush against the surface of the can end.

In a preferred embodiment of the present invention, the curl extends completely around the peripheral edge of the nose portion of the pull tab. Additionally, the pull tab is provided with a finger end opposite the nose portion and the curl fades into a conventional hem toward the finger end on either side of the nose portion.

A coined "V" shape may be provided in the pull tab immediately in front of the tab rivet hole to keep the tab in which the rivet hole is pierced from tearing during the stress of opening.

Finally, a recessed portion may be provided in the can end and the score line may be located within the recessed portion. The recessed portion preferably extends from the open end of the U across the can end and provides a recess for the retracted pull tab against the surface of the can end.

The present invention also provides for the manufacture of a pull tab having a nose portion and being subjected to a plurality of successive forming operations as it is formed from a blank, which includes the steps of forming a pull tab blank, forming at least one knotch in the peripheral edge of the blank at the nose end thereof, to relieve compressive forces when the edge is curled, and curling the peripheral edge of the nose portion in successive steps to form an edge portion of continuous cylindrical cross-sectional shape so as to provide a high beam strength, to rigidize the nose portion, and to prevent failure of the pull tab by bending.

The manufacture may also include the step of coining a "V" shape in the pull tab immediately in front of the tab rivet hole to keep the tab in which the rivet hole is pierced from tearing during the stress of opening.

In a preferred embodiment, the knotches are semi-circular in shape and may comprise two in number, one on either side of the nose portion.

Other features of the invention will become apparent from the detailed description which follows.

DETAILED DESCRIPTION

Figures 1, 1A, 1B, 1C, 2:
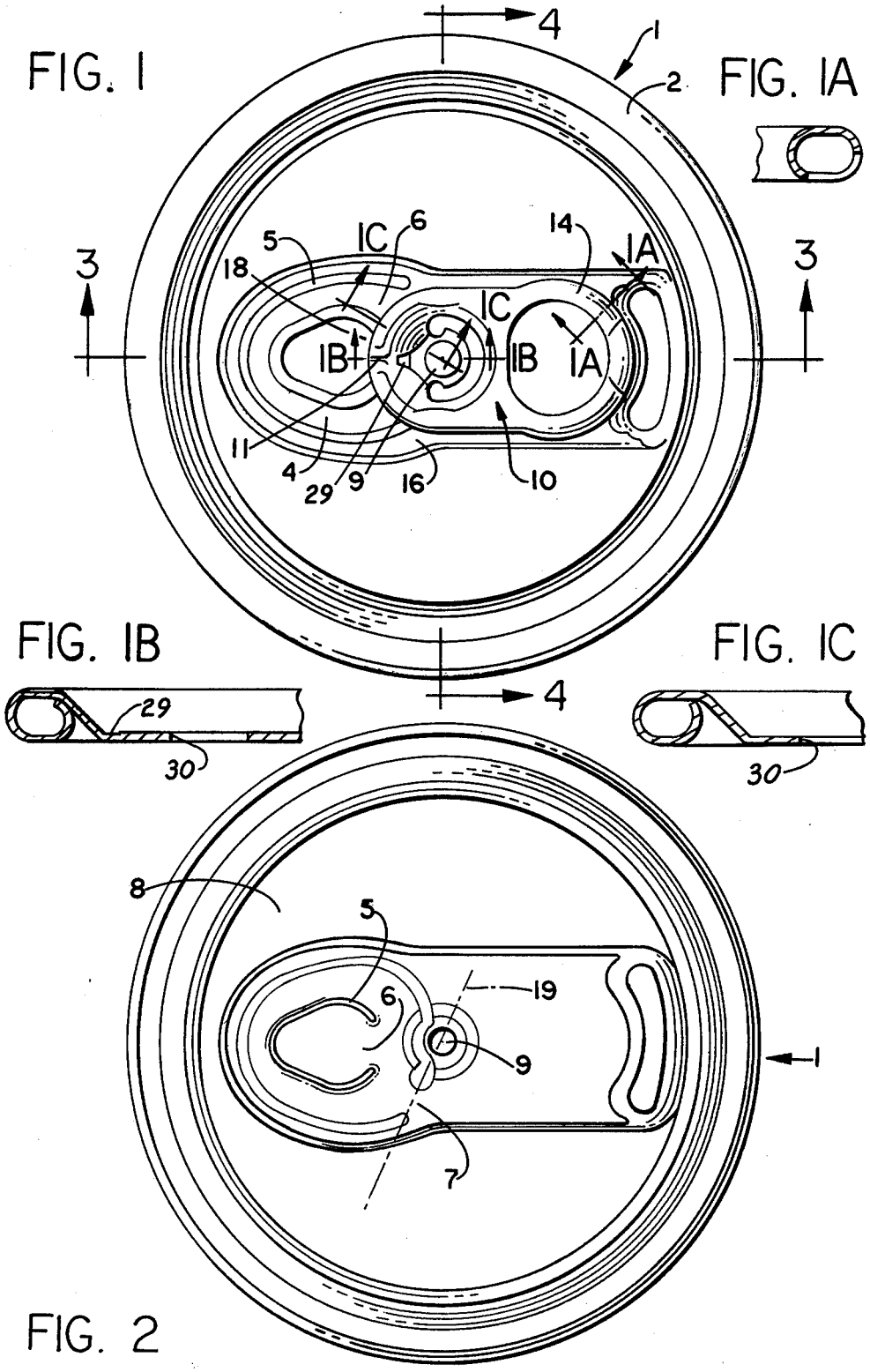
FIG. 1 is a top plan view of an easy open can end incorporating the improved pull tab of the present invention.
FIG. 1A is a cross-sectional view taken on the line 1A—1A of FIG. 1.
FIG. 1B is a cross-sectional view taken on the line 1B—1B of FIG. 1.
FIG. 1C is a cross-sectional view taken on the line 1C—1C of FIG. 1.
FIG. 2 is a bottom plan view of the can end of FIG. 1.
Figure 3:
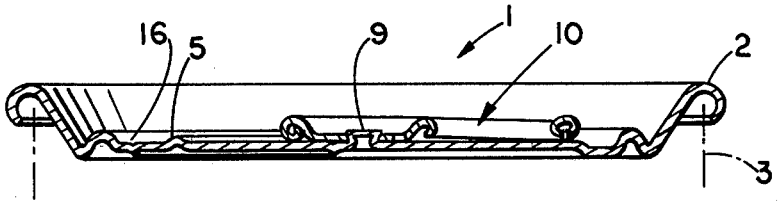
FIG. 3 is a cross-sectional view through the can end of FIG. 1 taken on the line 3—3.
Figure 4:
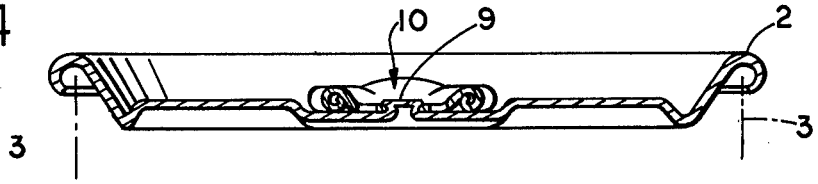
FIG. 4 is a cross-sectional view through the can end of FIG. 1 taken on the line 4—4.

The can end of the present invention is illustrated generally at 1 in FIG. 1, and is of generally circular shape including a circumferentially extending raised edge 2 for attaching can end 1 to a suitable cylindrical beverage can 3 or the like as is well known in the art. In general, can end 1 will be manufactured of a relatively ductile metal, such as aluminum, for example, but may be made from plastic or other materials as required.

A retained tear strip 4 extends across the can end 1 from a position spaced just inwardly of the raised edge 2 to approximately the center of the can end 1. Tear strip 4 is defined by a score or tear line 5 being generally U-shaped with the open end 6 of the U towards the center of the can end. Score line 5 is interrupted at 7 so that the tear strip will be captively retained on the underside 8 of the can end 1 when torn open.

An integral rivet 9 is positioned adjacent the open end 6 of the U-shaped score line 5 outside the score line 5, and a graspable ring-like pull tab 10, which may be of any desired size and configuration, is secured to the can end 1 by means of the rivet 9. The pull tab 10 is provided with a nose portion 11 to initiate a tear along the score line 5 upon lifting of the pull tab 10 to tear open the tear strip 4 as is well known in the art. The peripheral edge 12 of the nose portion 11 is curled into a cylindrical cross-sectional shaped curl or edge portion 13 to provide a high beam strength and to rigidize the nose portion 11 and to prevent failure by bending before the tear strip 4 is opened. The curl 13 preferably extends completely around the peripheral edge 12 of the nose portion 11 of the pull tab 10. As can be seen, the pull tab 10 is provided with a finger end 14 opposite the nose portion 11. The curl 13 preferably fades into a conventional hem 15 toward the finger end 14 on either side of the nose portion 11.

As best seen in FIGS. 1, 1B and 1C, a coined "V" shape 29 is provided in the pull tab 10 immediately in front of the tab rivet hole 30 to keep the tab 24 in which the rivet hole 30 is pierced from tearing during the stress of opening.

A recessed portion 16 is provided in the can end 1 with the score line 5 being located therein. As can be seen, the recessed portion 16 extends from the open end 6 of the U-shaped score line 5 across the can end 1 to provide a recess for the retracted pull tab 10.

In a preferred embodiment, the tear strip 4 may be provided with a suitable raised strengthening rim 17 of any desired configuration, but which, as shown, is generally U-shaped with the open end 18 of the U toward the rivet 9.

Figure 5:
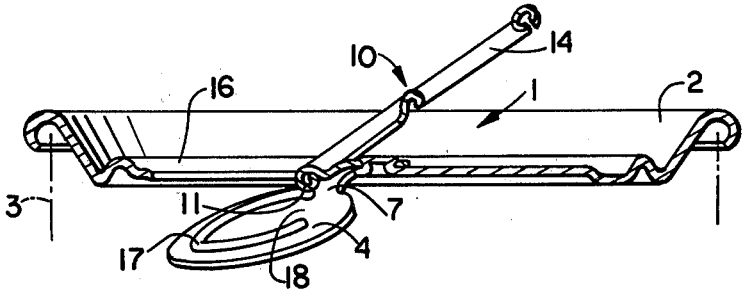
FIG. 5 is a cross-sectional view similar to FIG. 3 showing the initiation of opening the tear strip.
Figure 6:
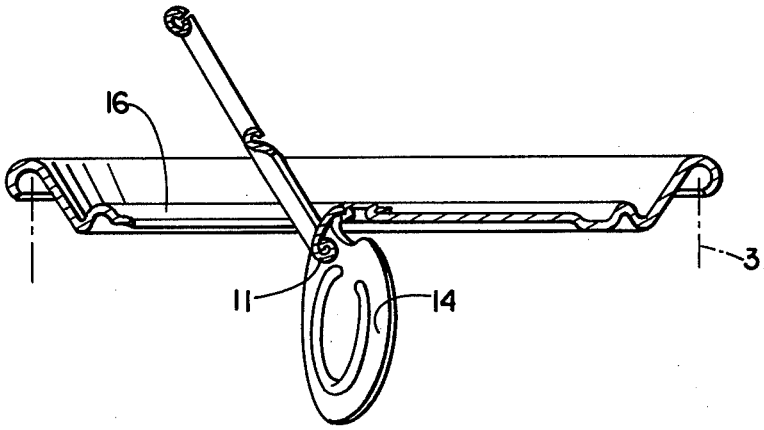
FIG. 6 is a cross-sectioal view similar to FIG. 5 showing the can end with the tear strip in the fully opened position.

At this point, the pull tab 10 and tear strip 4 will appear as shown in FIGS. 5 and 6.

Figure 7:
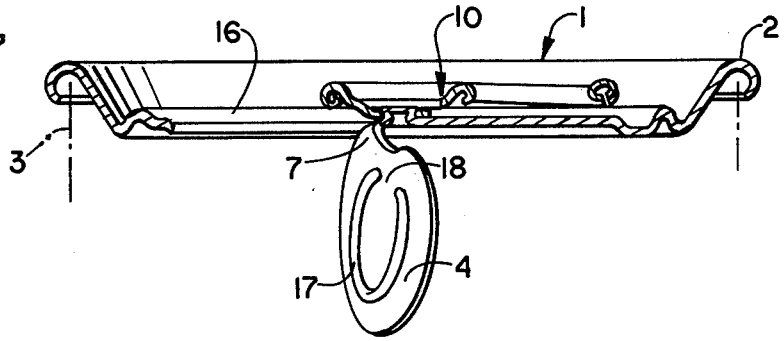
FIG. 7 is a cross-sectional view similar to FIGS. 5 and 6 showing the can end with the tear strip in the fully opened position and the pull tab in its retracted position.

Turning to FIG. 5, it will be seen that when the pull tab 10 is raised, the nose portion 11 thereof initiates a tear along the score line 5, causing the tear strip 4 to bend downwardly along the line indicated at 19. The exact position of this bend may vary from a point substantially tangent to the front of the rivet 9 to a point perhaps 1/16th inch or more behind the rivet 9, i.e. away from the nose portion 11. As the pull tab 10 is raised further, the score line 5 is caused to tear therearound, except for the interrupted portion 7, as best seen in FIG. 6. Accordingly, the tear strip 4 is thus captively retained on the underside 8 of the can end 1. When the pull tab 10 has been raised so that the tear strip 4 is fully open, as best seen in FIG. 6, it may be retracted so as to lie substantially flush against the surface of the can end 1 within the recessed portion 16, as best seen in FIG. 7.

Figure 8A:
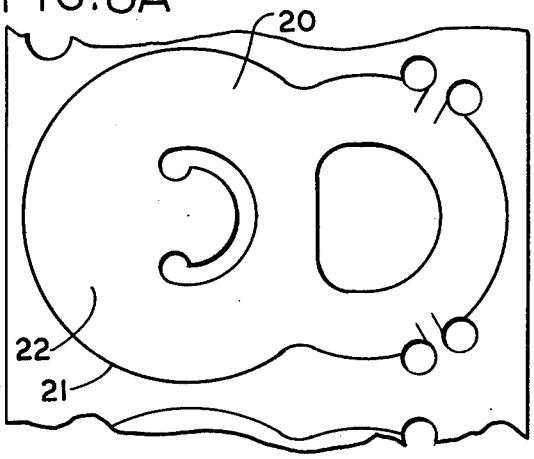
FIG. 8A is a plan view of a prior art pull tab blank during the forming operation prior to curling of the peripheral edge thereof.
Figure 8B:
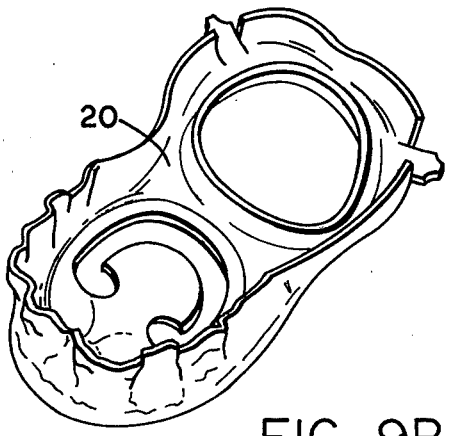
FIG. 8B is a perspective view of a partially, malformed pull tab formed from the pull tab blank of FIG. 8A.

A prior art pull tab 20 is shown in FIGS. 8A and 8B. Note that the pull tab 20 is formed from a blank and that the peripheral edge 21 of the nose portion 22 is curled in successive steps to form an edge portion 23. However, the difficulty in producing this type of curl is the th metal must compress as the curl is formed. In practice, the curled edge portion 23 is discontinuous and malformed, caused by the metal attempting to relieve the compressive forces.

Figure 9A:
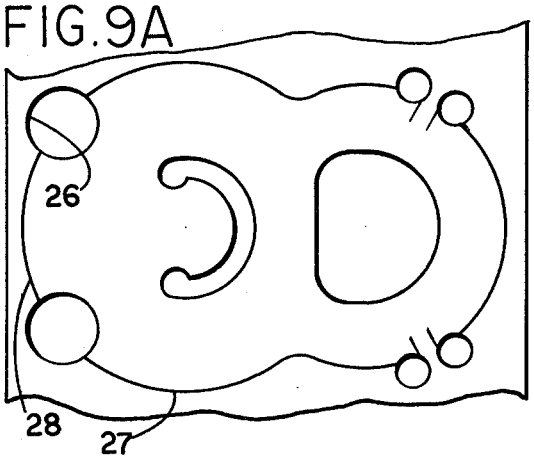
FIG. 9A is a plan view of a pull tab blank of the present invention.

The manufacture of the pull tab 10 of the present invention is shown in FIGS. 9A through 9D. During the manufacturing process, at least one pull tab blank 24 is formed, perferably in a metallic strip 25, as shown in FIG. 9A. At least one relief knotch 26 is then formed in the peripheral edge 27 of the blank 24 at the nose portion 28 thereof. The knotches 26 may be semi-circular in shape, which is achieved by punching circular holes into the strip 25. It will, of course, be understood that these relief knotches 26 may be of a shape other than circular and that the number may vary, although preferably the knotches 26 comprise two in number, one on either side of the nose portion 28.

Figure 9B:
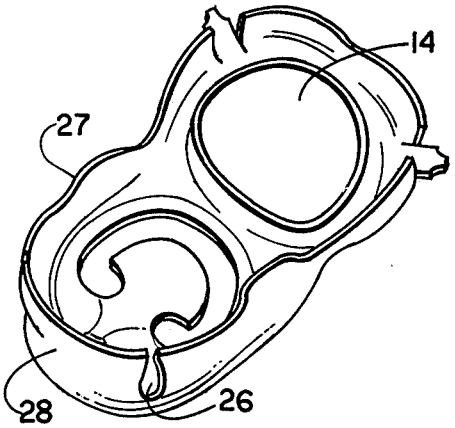
FIGS. 9B through 9D are perspective views showing the curling of the peripheral edge of the nose portion of the pull tab of the present invention in successive steps to form an edge portion of continuous cylindrical cross-sectional shape.
Figure 9C:
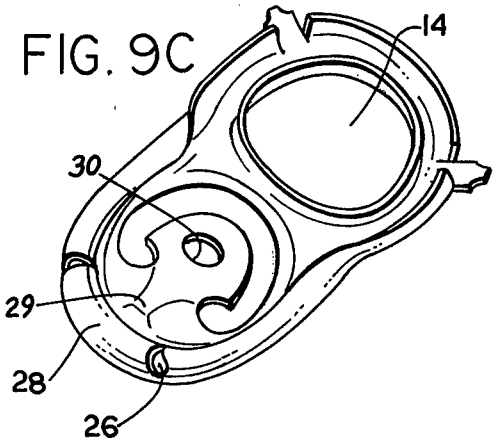
Figure 9D:
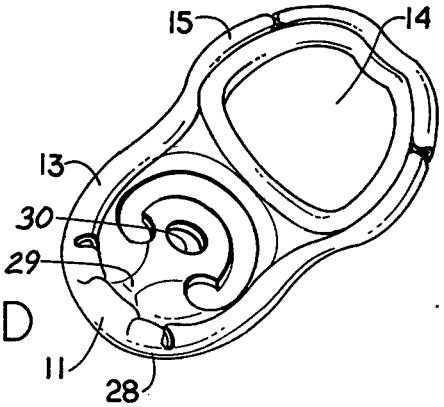

In FIGS. 9B through 9D, it will be seen that the peripheral edge 27 of the nose portion 28 of the pull tab blank 24 is curled in successive steps to form an edge portion 11 of continuous cylindrical cross-sectional shape, so as to provide a high beam strength, to rigidize the nose portion 28 and to prevent failure of the pull tab 10 by bending. The compressive forces during curling are relieved by the relief knotches 26. As will be seen, when the metal is curled, when the relief knotches 26 are provided, the curl forms nicely and the knotches 26 are almost closed in the final curl.

The pull tab construction of the present invention provides a curled edge portion 11 which is very strong and allows use of aluminum in the 0.014 inch to 0.016 inch thickness range as opposed to the 0.016 inch to 0.018 inch thickness range now in commercial use. Further, the number of operations required to produce the pull tab 10 can be reduced to ten as compared to the sixteen or more operations used for other prior art retained pull tabs.

It will also be seen that during the manufacture of the pull tab 10, a coined "V" shape 29 is provided in the pull tab 10 immediately in front of the tab rivet hole 30 to keep the tab 24 in which the rivet hole is pierced from tearing during the stress of opening.

It will be understood that the changes in the details, materials, steps and arrangements of parts, which have been herein described and illustrated or to explain the nature of the invention, may be made by those skilled in the art within the principle and scope of the invention as expressed in the appended claims.

What is claimed is:

1. In an easy open can end having a score line defining a tear strip, said score line being generally U-shaped with the open end of the U towards the center of said can end, said open end being interrupted so that said tear strip will be captively retained on the underside of said can end when torn open, an integral rivet adjacent the open end of the U outside said score line, and a pull tab secured to said can end by means of said rivet, said pull tab having a nose portion to initiate a tear along said score line upon lifting of said pull tab, the edges of said nose portion being curled into a continuous cylindrical cross-sectional shape to provide a high beam strength and to rigidize said nose portion and to prevent failure by bending before said tear strip is opened, whereby said pull tab, when raised, the nose portion thereof initiates a tear along said score line, causing said tear strip to bend downwardly along a transverse line in front of said rivet, and when raised further, causing said score line to tear therearound, except for said interrupted portion thereof, said tear strip thus being captively retained on the underside of said can end, and when said tear strip is fully opened, to be retracted so as to lie substantially flush against the surface of said can end.

2. The can end according to claim 1, wherein said curl extends completely along the peripheral edge of said nose portion.

3. The can end according to claim 1, wherein said pull tab is provided with a finger end opposite said nose portion and said curl fades into a conventional hem toward said finger end on either side of said nose portion.

4. The can end according to claim 1, wherein a coined "V" shape is provided in said pull tab immediately in front of said rivet to keep said pull tab from tearing during the stress of opening.

5. The can end according to claim 1, wherein a recessed portion is provided in said can end and said score line is located within said recessed portion, said recessed portion extending from said open end of the U across said can end to provide a recess for said retracted pull tab.

6. The can end according to claim 1, wherein said tear strip is provided with a raised strengthening rim.

7. The can end according to claim 6, wherein said strengthening rim is generally U-shaped with the open end of the U toward said rivet.

* * * * *